US007677824B2

(12) United States Patent
Yoon

(10) Patent No.: US 7,677,824 B2
(45) Date of Patent: Mar. 16, 2010

(54) SLIDE PEN

(75) Inventor: Hyun-son Yoon, Seoul (KR)

(73) Assignee: Morris Corporation, Seoul (KR)

( * ) Notice: Subject to any disclaimer, the term of this patent is extended or adjusted under 35 U.S.C. 154(b) by 244 days.

(21) Appl. No.: 11/764,168

(22) Filed: Jun. 15, 2007

(65) Prior Publication Data

US 2008/0003047 A1 Jan. 3, 2008

(30) Foreign Application Priority Data

Jun. 30, 2006 (KR) ..... 10-2006-0060460

(51) Int. Cl.
*B43K 7/12* (2006.01)

(52) U.S. Cl. ..... 401/103; 401/99; 401/104; 401/117

(58) Field of Classification Search ..... 401/99, 401/104–106, 115, 117, 103
See application file for complete search history.

(56) References Cited

U.S. PATENT DOCUMENTS 3,046,943 A * 7/1962 Rhoades ..... 401/117
4,995,750 A * 2/1991 Akita ..... 401/104
5,044,805 A * 9/1991 Kosteniuk et al. ..... 401/82
6,290,413 B1 * 9/2001 Wang ..... 401/30
6,296,409 B1 * 10/2001 Cherry et al. ..... 401/6

* cited by examiner

*Primary Examiner*—David J. Walczak
*Assistant Examiner*—Ryan A Varnum
(74) *Attorney, Agent, or Firm*—Intellectual Property Law Group LLP; Juneko Jackson; Otto O. Lee

(57) ABSTRACT

Disclosed is a slide pen. The slide pen includes (a) a pen core having a nib, (b) a tubular pen core slider having an open lower end, a pen core coupler, and guide ridges formed at an upper portion thereof, so as to allow the nib of the pen core to protrude through the lower end thereof and to allow the pen core to be held and coupled therein, and (c) a body casing having a tubular upper portion formed with a guide slot so as to allow the guide ridges of the pen core slider to vertically move and be fixed, a tubular intermediate portion being partially open such that the pen core slider is held inside so as to allow the outer circumference of the pen core slider to be exposed outside, and a conical lower portion having an open lower end so as to allow the nib of the pen core to be moved in and out. Thereby, when the guide ridges of the pen core slider vertically move in the guide slot of the upper portion of the body casing, the pen core slider slides in the body casing, and the nib of the pen core coupled to the pen core coupler of the pen core slider comes in and out through the lower end of the body casing.

7 Claims, 10 Drawing Sheets

SLIDE PEN

CROSS-REFERENCE TO RELATED APPLICATIONS

This application claims priority to Korean application no. 10-2006-0060460, filed Jun. 30, 2006, which is hereby incorporated by reference for all purposes.

BACKGROUND OF THE INVENTION

1. Field of the Invention

The present invention relates, in general, to a slide pen having a pen core, a pen core slider, and a body casing, in which the pen core is moved in and out by means of the movement of a pen core slider coupled with a pen core held in the body casing.

2. Description of the Prior Art

In general, a writing implement comprises a pen core and spring, a pen core case, an operating button, and upper and lower cases.

In order to use the writing implement having this operating button, the operating button, located at an upper portion of the writing implement, is pressed to protrude the pen core. When use of the writing implement is complete, the operating button is again pressed to retract the pen core. Thereby, the writing implement enters a portable state.

This operating button is usually adapted to operate a lock and gear to protrude or retract the pen core.

More specifically, in a state where the lock and gear, which are interlocked with each other, are seated in a hooking recess in the upper case, when a user applies a predetermined force to the operating button, the lock and gear are detached from the locking recess, and thus rotate and move forward in the direction in which the operating button is pressed.

Then, when no force is applied to the operating button, the lock and gear rotate, and a protrusion of the gear is hooked on a hooked step of the upper case. This operation causes the pen core to be pushed downward by the force applied to the lock, and thereby the pen core protrudes outside the lower case.

In the opposite case, upon completion of use of the writing implement, when the user applies a predetermined force to the operating button again, the lock and gear are detached from the hooked step, and rotate and move forward in the direction in which the operating button is pressed.

Then, when no force is applied to the operating button, the lock and gear rotate, and are seated in the hooking recess of the upper case. This operation causes a resilient portion to be recovered from elastic deformation, and thereby the pen core is retracted into the lower case.

However, most of these lock-type writing implements include four or five constituent pieces, such as the pen core case, the operating button, the upper and lower cases, and so on, that is, they have many parts and a complicated structure, so that the production cost thereof is high, and assembly is difficult.

SUMMARY OF THE INVENTION

Accordingly, the present invention has been made keeping in mind the above problems occurring in the prior art, and an object of the present invention is to provide a slide pen having a pen core, a pen core slider holding and coupling the pen core, and a body casing holding the pen core slider, wherein the pen core is moved in and out by sliding the pen core slider, with the goal of providing a writing implement having a simple structure and easy assembly.

In order to achieve the above object, according to one aspect of the present invention, there is provided a slide pen, which includes (a) a pen core having a nib, (b) a tubular pen core slider having an open lower end, a pen core coupler, and guide ridges formed in an upper portion thereof, so as to allow the nib of the pen core to protrude through the lower end thereof and to allow the pen core to be held and coupled therein, and (c) a body casing having a tubular upper portion formed with a guide slot to allow the guide ridges of the pen core slider to vertically move and be fixed, a tubular intermediate portion of which is partially open such that the pen core slider is held inside so as to allow the outer circumference of the pen core slider to be exposed outside, and a conical lower portion having an open lower end so as to allow the nib of the pen core to be moved in and out.

With this construction, when the guide ridges of the pen core slider vertically move in the guide slot of the upper portion of the body casing, the pen core slider can slide in the body casing, and the nib of the pen core coupled to the pen core coupler of the pen core slider can move in and out through the lower end of the body casing.

Here, the guide slot of the upper portion of the body casing may communicate with one end of the intermediate portion of the body casing, because the guide ridges of the pen core slider are adapted to pass through the guide slot when the pen core slider coupled with the pen core is inserted into the body casing, and thereby the pen core slider coupled with the pen core can be assembled to the body casing.

Further, the guide ridges may include a circular guide ridge having a circular shape in a vertical section and a quadrangular guide ridge having a quadrangular shape in a horizontal section and extending upwards from the circular guide ridge, and the guide slot corresponding to the guide ridges may include a first passage slot that communicates with the open intermediate portion of the body casing to allow the guide ridges of the pen core slider to pass therethrough first when the pen core slider is held in the body casing, a pair of circular slots that communicates with the first passage slot and is formed up and down to be able to clamp the circular guide ridge of the guide ridges, a second passage slot that is formed between the paired circular slots and causes elastic deformation when the circular guide ridge passes therethrough, and a linear slot that communicates with the upper one of the paired circular slots and allows the quadrangular guide ridge of the guide ridges to pass therethrough.

Alternatively, when the guide ridges include an elliptical guide ridge having an elliptical shape in a vertical section, the guide slot corresponding to the guide ridges may include a pair of elliptical slots.

Further, the slide pen may further include a sheath that encloses the outer circumference of the pen core slider which is exposed to the open intermediate portion of the body casing when the pen core slider is held in the body casing. The sheath may have a length equal to or shorter than that of the open intermediate portion of the body casing, and the movement distance of the sheath may be shorter than the distance that the guide ridges of the pen core slider move in the guide slot of the body casing.

If the length of the sheath is longer than that of the open intermediate portion of the body casing, the pen core slider cannot be assembled with the body casing. Further, if the difference between the length of the sheath and the length of the open intermediate portion of the body casing is smaller than the distance that the guide ridges of the pen core slider move in the guide slot, the movement distance of the pen core slider is insufficient, so that the nib of the pen core cannot be protruded far enough. That is, the sheath is shorter than the open intermediate portion of the body casing, and the difference in length between the sheath and the open intermediate portion of the body casing must be greater than the distance that the guide ridges of the pen core slider move in the guide slot of the body casing.

Most preferably, the length of the sheath may be shorter than that of the open intermediate portion of the body casing, and the movement distance of the sheath may be equal to the distance that the guide ridges of the pen core slider move in the guide slot of the body casing. Thereby, the pen core slider smoothly slides and the nib of the pen core can protrude sufficiently.

Further, the pen core slider may have the shape of a tube that is partially open so as not to be exposed when coupled to the body casing, and the pen core coupler of the pen core slider may include a pair of opposite flat plates formed at an inner portion of the pen core slider, and the pen core may be coupled between the pair of flat plates.

Meanwhile, the pen core slider may further include a clip, and the clip may be integrally formed with the guide ridges.

In addition, the slide pen may include the sheath as described above, and the sheath may be formed with an embossed portion at a grip portion when the nib of the pen core is moved out, and the body casing in connection with the sheath may be formed with an embossed portion at a grip portion when the nib of the pen core is moved out. In other words, when the nib of the pen core is moved out, the embossed portions serving as the grip portions of the sheath and the body casing may be symmetrical with respect to each other.

Meanwhile, the pen core slider and the body casing generally have a circular shape in a transverse section, but it does not matter if they have a quadrangular shape, a hexagonal shape, an octagonal shape, or the like. If the pen core slider and the body casing have any one of the quadrangular, hexagonal, and octagonal shapes in a transverse section, the sheath of the pen core slider has a planar shape, or a quadrangular, hexagonal, or octagonal shape in a transverse section (and, if the pen core slider and the body casing have a circular shape in a transverse section, the sheath of the pen core slider will have a cross section in a "C" shape). Further, the pen core slider and the intermediate portion of the body casing, which are open, will have the cross section of a quadrangular, hexagonal, or octagonal shape, when the pen core slider and the body casing have any one of the quadrangular, hexagonal, and octagonal shapes in a transverse section (and, if the pen core slider and the body casing have a circular shape in a transverse section, the pen core slider and the intermediate portion of the body casing, which are open, will have a cross section in a "C" shape).

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
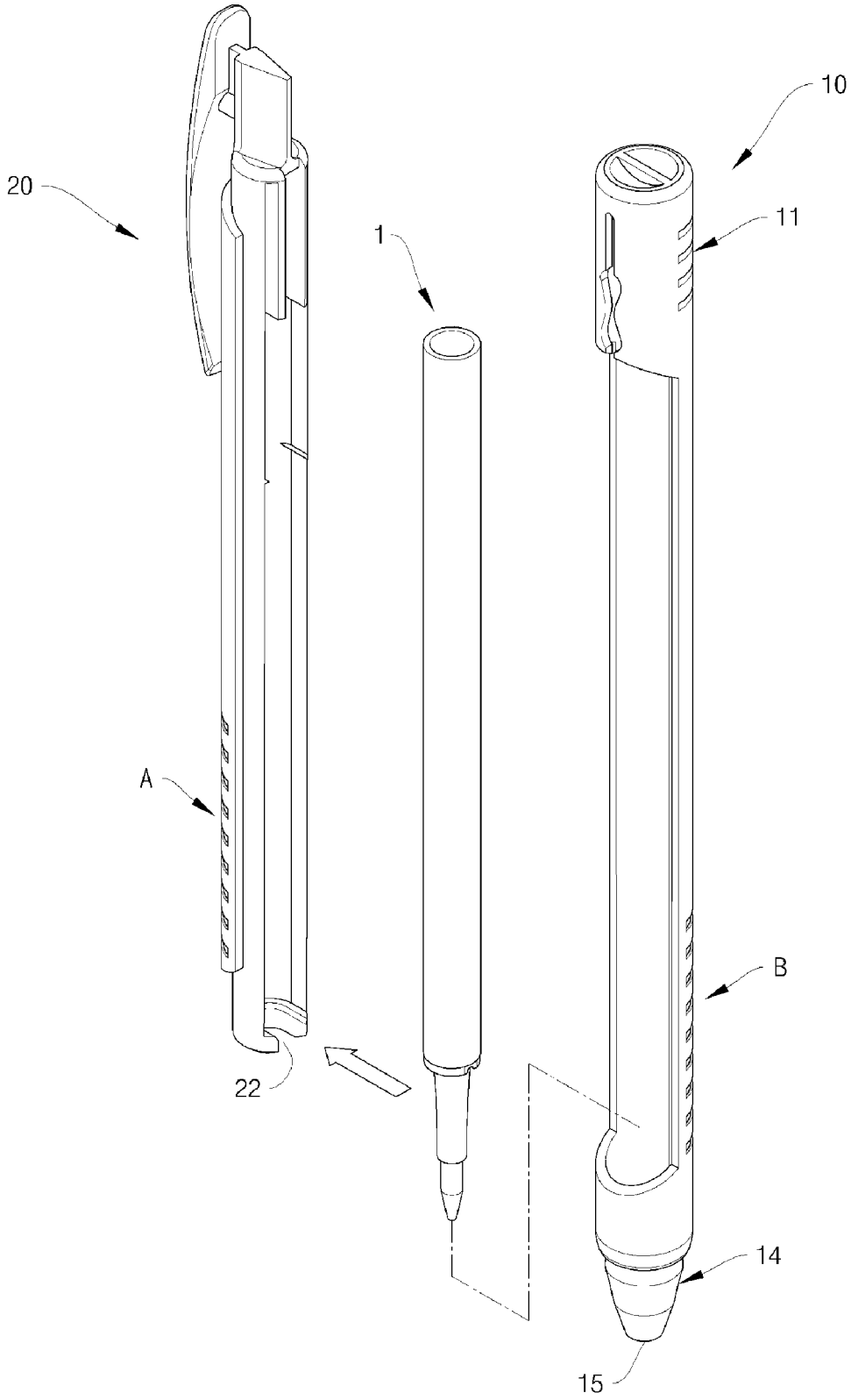
FIG. 1 is an exploded perspective view illustrating a slide pen according to an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is an exploded perspective view illustrating a slide pen according to an embodiment of the present invention.

As illustrated in FIG. 1, the slide pen is comprised of a pen core 1, a pen core slider 20 holding the pen core 1 and removably coupled with the pen core, and a body casing 10 removably holding the pen core slider 20.

The body casing 10 has an intermediate portion that is partially open. Similarly, the pen core slider 20 is partially open in a longitudinal direction. The pen core 1 is coupled to the pen core slider 20, and then the pen core slider 20 having the pen core 1 is assembled into the body casing 10. As a result, the slide pen of the present invention is obtained.

Figure 2A:
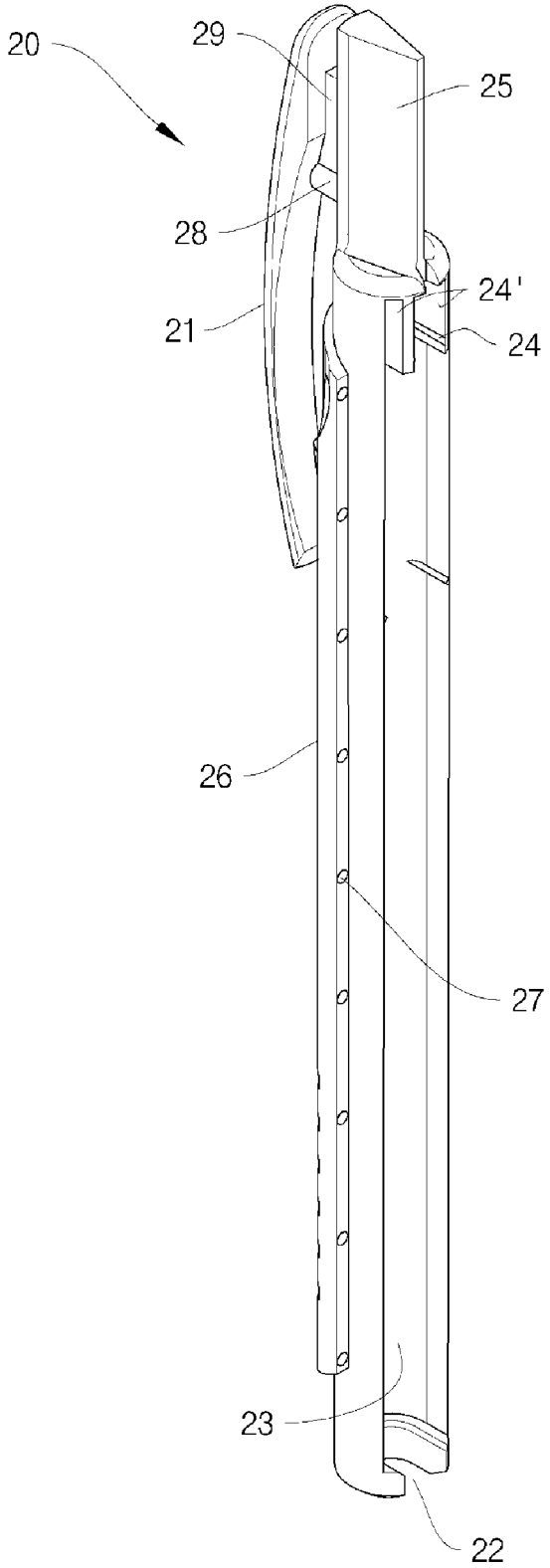
FIGS. 2A and 2B are a perspective view and side view, respectively, of the pen core slider of FIG. 1.
Figure 2B:
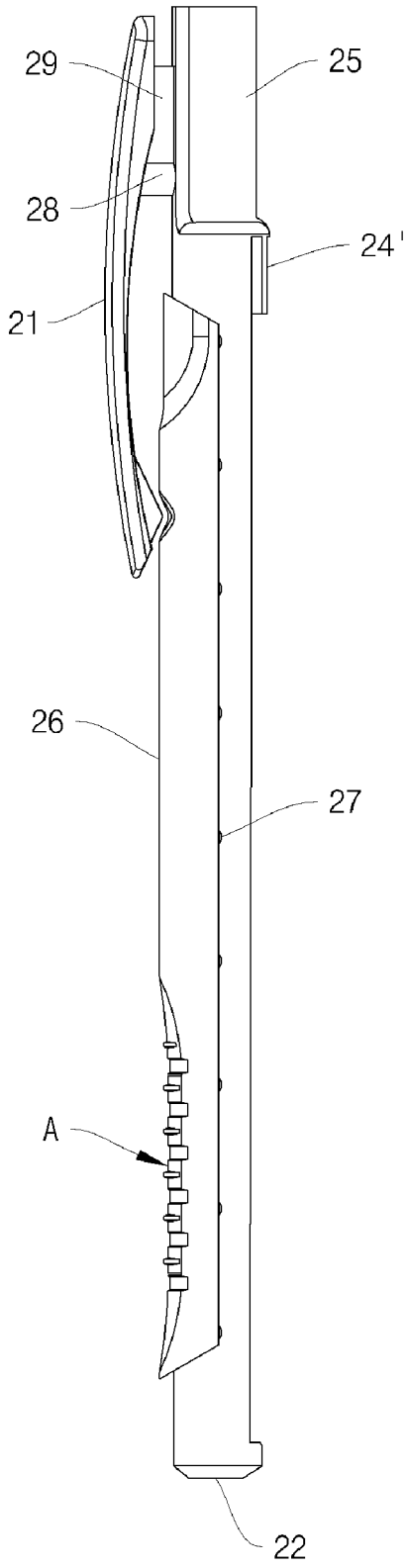
Figure 3A:
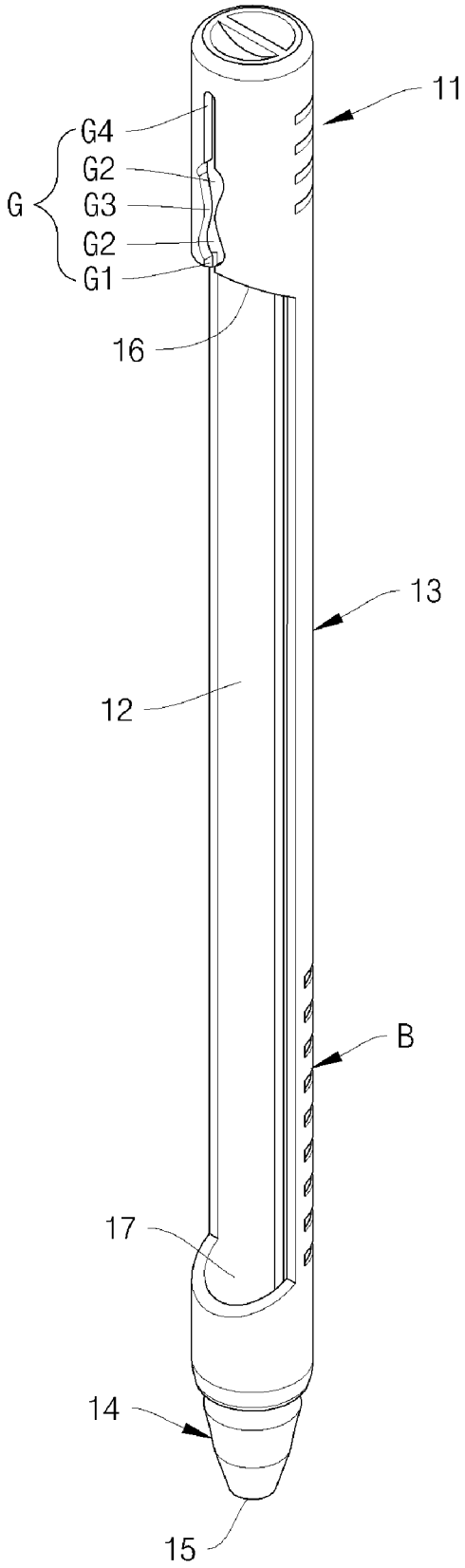
FIGS. 3A and 3B are a perspective view and side view, respectively, of the body casing of FIG. 1.
Figure 3B:
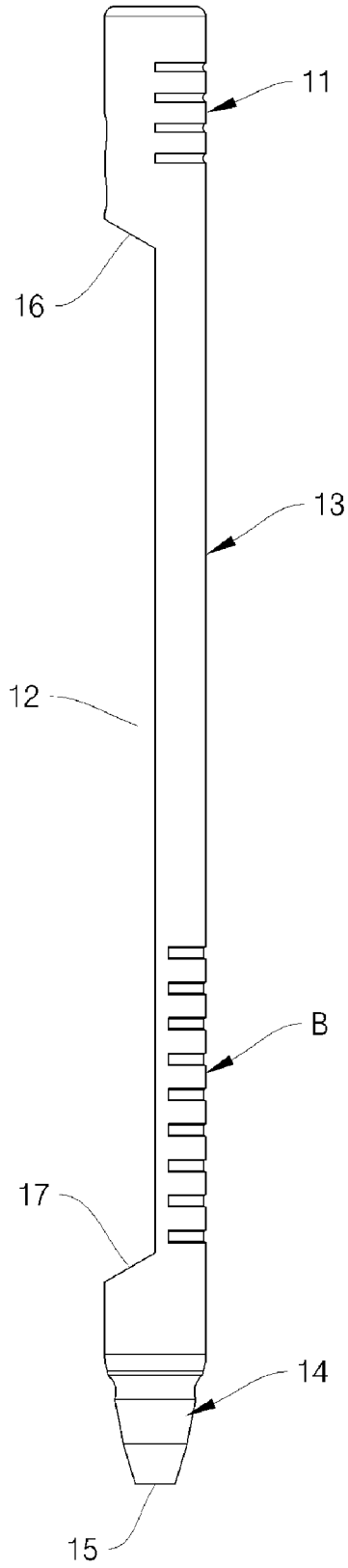

FIGS. 2A and 2B are a perspective view and side view, respectively, of the pen core slider 20 of FIG. 1, and FIGS. 3A and 3B are a perspective view and side view, respectively, of the body casing 10 of FIG. 1.

First, referring to FIGS. 2A and 2B, the pen core slider 20 takes the shape of a cylinder, the circumference of which is partially open from top to bottom, and includes a clip 21, a pen core support 22, a pen core holder 23, a pen core coupler 24, a sheath 26, and guide ridges 28 and 29.

Among them, the clip 21 serves to attach the slide pen to paper or the hem of clothing, as in ordinary writing implements.

Further, the head 25 is formed at an upper end of the pen core slider 20. Especially, the head 25 is integrally formed with the guide ridges 28 and 29, to be described below, to which the clip 21 is connected. In this manner, the head 25 serves to provide places at which the guide ridges 28 and 29 can be integrally formed.

In short, the guide ridges 28 and 29 are integrally connected with the clip 21 and the head 25. The guide ridges 28 and 29 are constructed such that a guide ridge 28 having an elliptical shape in a vertical section is integrated with a guide ridge 29 that has a quadrangular shape in a horizontal section and extends upwards from the guide ridge 28. Because the elliptical guide ridge 28 and the quadrangular guide ridge 29 are integrally formed, the guide ridges 28 and 29 can be regarded as having a microphone shape on the whole. Here, the quadrangular guide ridge 29 has a trapezoidal shape in a vertical section, where the thickness is reduced in an upward direction so as to allow the guide ridges 28 and 29 to smoothly move in a guide slot, to be described below, of the body casing 10.

Meanwhile, the pen core holder 23 refers to the inside of the pen core slider 20, a part of which is open in a vertical direction. The pen core coupler 24 is constituted of a pair of flat plates 24', which are integrally formed at an upper inner portion of the pen core slider 20. The pen core 1 is held in the pen core holder 23, and has an upper portion interposed and connected between the pair of flat plates 24'.

The pen core support 22 has a "C" shaped step, which is integrally formed inside the lower end of the pen core slider 20, and cooperates with a protrusion provided on the pen core 1, as illustrated in FIG. 1. However, as long as the slide pen of the present invention can be driven by connection of the pen core 1 and the pen core coupler 24, the pen core support 22 is not an essential component of the slide pen.

The pen core slider 20 is also provided with the sheath 26 on an outer circumference thereof. The sheath 26 is adapted to enclose the outer circumference of the pen core slider 20, which is exposed to the open intermediate portion of the body casing when the pen core slider 20 is held in the body casing 10. The sheath 26 should have a length equal to or shorter than that of the open intermediate portion of the body casing 10. The difference between the length of the sheath 26 and the length of the open intermediate portion of the body casing 10 should be equal to or greater than the distance that the guide ridges 28 and 29 of the pen core slider 20 move in the guide slot G of the body casing 10. For example, if the movement distance of the sheath 26 is 1 cm, the length of the open intermediate portion of the body casing 10 should be longer than 1 cm plus the length of the sheath. As another example, if the length of the sheath 26 is 8 cm, and the length of the open intermediate portion of the body casing 10 is 10 cm, the distance that the guide ridges 28 and 29 of the pen core slider 20 move in the guide slot G of the body casing 10 should be shorter than 2 cm (=10 cm−8 cm).

If the length of the sheath 26 is longer than that of the open intermediate portion of the body casing 10, the pen core slider 20 cannot be assembled to the body casing 10. Further, if the difference between the length of the sheath 26 and the length of the open intermediate portion of the body casing 10 is smaller than the distance that the guide ridges 28 and 29 of the pen core slider 20 move in the guide slot G, the movement distance of the pen core slider 20 is insufficient, so that the nib of the pen core 1 cannot be protruded. Preferably, the length of the sheath 26 is shorter than that of the open intermediate portion of the body casing 10, and the difference between the length of the sheath 26 and the length of the open intermediate portion of the body casing 10 is equal to the distance that the guide ridges 28 and 29 of the pen core slider 20 move in the guide slot G of the body casing 10. In this case, the pen core slider 20 can be adapted to move from side to side, or the nib of the pen core 1 can be adapted to properly protrude.

Here, the upper and lower ends of the sheath 26 are preferably formed to come into contact with upper and lower ends of the open intermediate portion of the body casing 10, respectively. Further, when the nib of the pen core 1 is protruded for writing, a grip portion of the sheath 26 is preferably formed with an embossed portion A to correspond to an embossed portion B of a grip portion of the body casing 10.

Further, the sheath 26 is preferably formed with a plurality of convex noses 27 having the same shape at regular intervals on opposite lateral ends thereof. The noses 27 are brought into contact with opposite lateral ends of the open intermediate portion of the body casing 10. Thereby, during a writing operation, the noses 27 increase frictional force to prevent the pen core 1 from being moved back. On the contrary, during a sliding operation after the writing operation, the noses 27 minimize surface contact and thus the generation of frictional force, thereby guaranteeing smooth sliding.

Meanwhile, referring to FIGS. 3A and 3B, the body casing 10 includes a tubular upper portion 11, the guide slot G formed at the upper portion 11, the partially open intermediate portion 13, and a conical lower portion 14 having a tip 15 open to allow the nib of the pen core 1 to move in and out. Here, the conical lower portion 14 having the open tip 15 is typically adapted to be removably coupled to the body casing 10.

Upper and lower ends of the tubular upper portion 11 of the body casing 10 are provided with a head entrance 16 through which the head 25 of the pen core slider 20 enters or exits when the pen core slider 20 assembled with the pen core 1 is held in the body casing 10, and a pen core entrance 17 through which the pen core 1 assembled to the pen core slider 20 enters or exits.

Here, the guide slot G of the body casing 10 includes a first passage slot G1 that the guide ridges 28 and 29 of the pen core slider 20 pass through first when the pen core slider 20 is held in the body casing 10, and that communicates with the open intermediate portion 13 of the body casing 10, a pair of elliptical slots G2 that communicates with the first passage slot and is formed up and down to be able to clamp the elliptical guide ridge 28 of the guide ridges 28 and 29, a second passage slot G3 that is formed between the paired elliptical slots G2 and causes elastic deformation when the elliptical guide ridge 28 passes therethrough, and a linear slot G4 that communicates with the upper one of the paired elliptical slots G2 and allows the quadrangular guide ridge 29 of the guide ridges 28 and 29 to pass therethrough.

Therefore, after the pen core slider 20 is held in the body casing 10, when a user slides the sheath 26 of the pen core slider 20 with one hand, the guide ridges 28 and 29 of the pen core slider 20 move along the guide slot G of the body casing 10, and thus the nib of the pen core 1 moves in and out.

When the elliptical guide ridge 28 of the guide ridges 28 and 29 is positioned in the upper one of the paired elliptical slots G2, the nib of the pen core 1 is in a retracted state. In contrast, when the elliptical guide ridge 28 of the guide ridges 28 and 29 is positioned in the lower one of the paired elliptical slots G2, the nib of the pen core 1 is in a protruded state.

Figure 4:
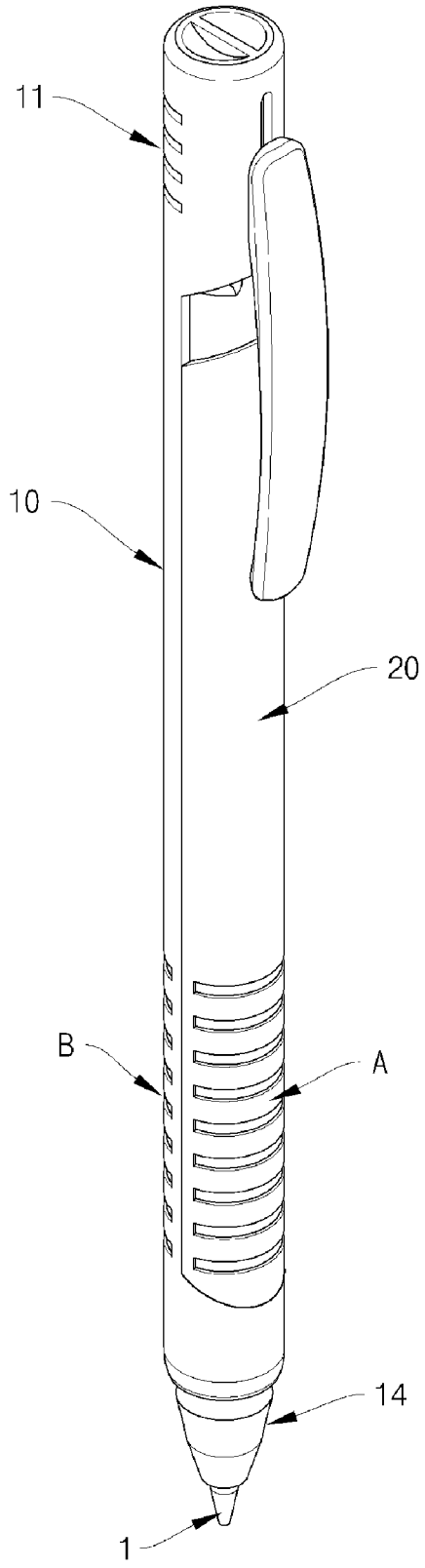
FIG. 4 is a perspective view illustrating the assembled state of a slide pen of the present invention.
Figure 5:
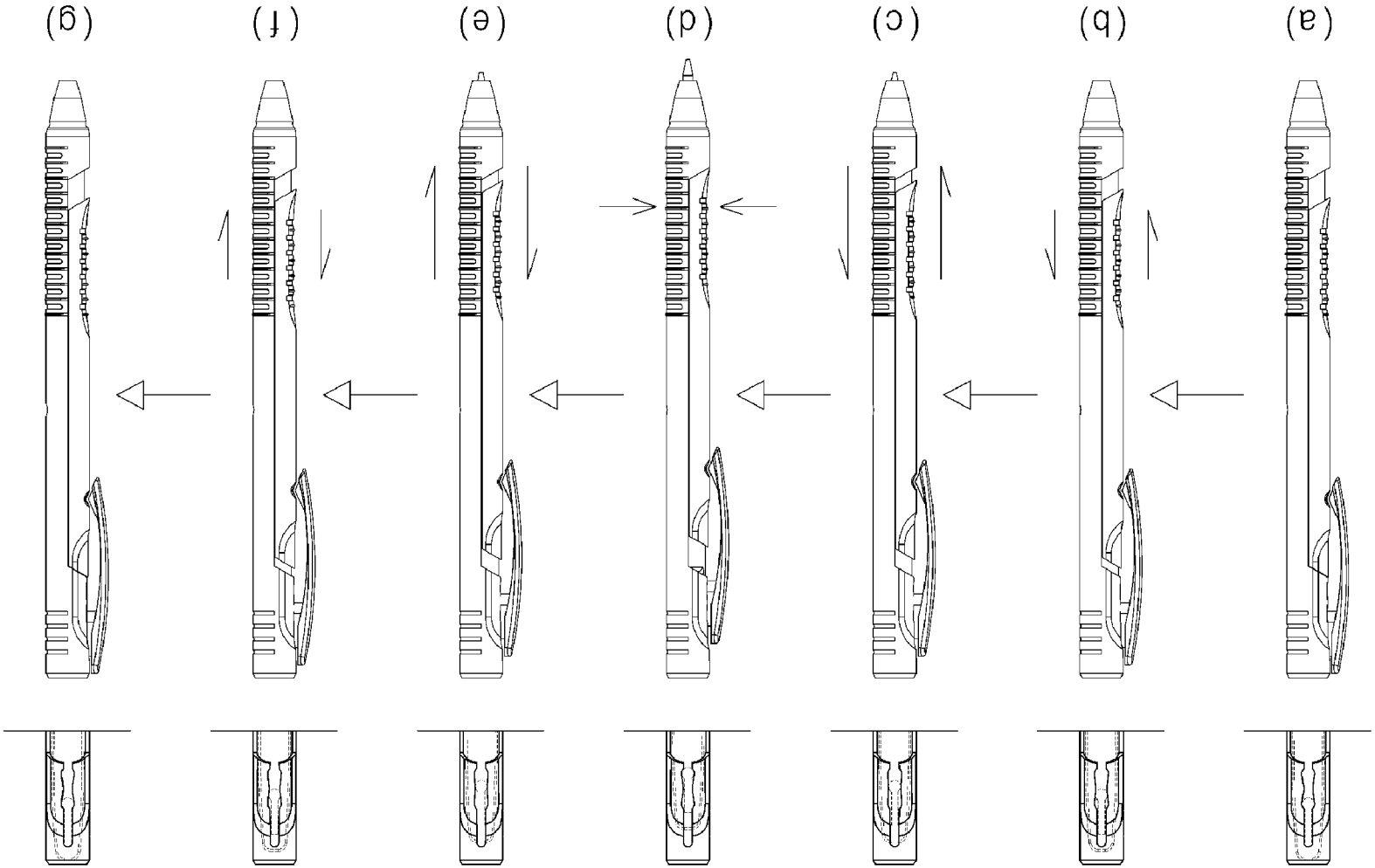
FIG. 5 illustrates how the nib of a pen core in a slide pen of the present invention comes in and out.

FIG. 4 is a perspective view illustrating the state where the pen core slider 20 assembled with the pen core 1 is held in the body casing 10, and then the nib of the pen core 1 is in a protruding state. FIG. 5 illustrates how the guide ridges 28 and 29 of the pen core slider 20 move in the guide slot G of the body casing 10 when the nib of the pen core 1 moves in and out.

In FIG. 5, each dotted line indicates the guide ridges 28 and 29 of the pen core slider 20.

Meanwhile, when the nib of the pen core 1 is moved out, the user writes while grasping the grip portion A of the sheath 26 of the pen core slider 20 and the grip portion B of the body casing 10 with the forefinger, middle finger and thumb. At this time, the forefinger and thumb press the pen core slider 20 and body casing 10, respectively, so that the nib of the pen core 1 is more strongly fixed in a protruding state.

Figure 6A:
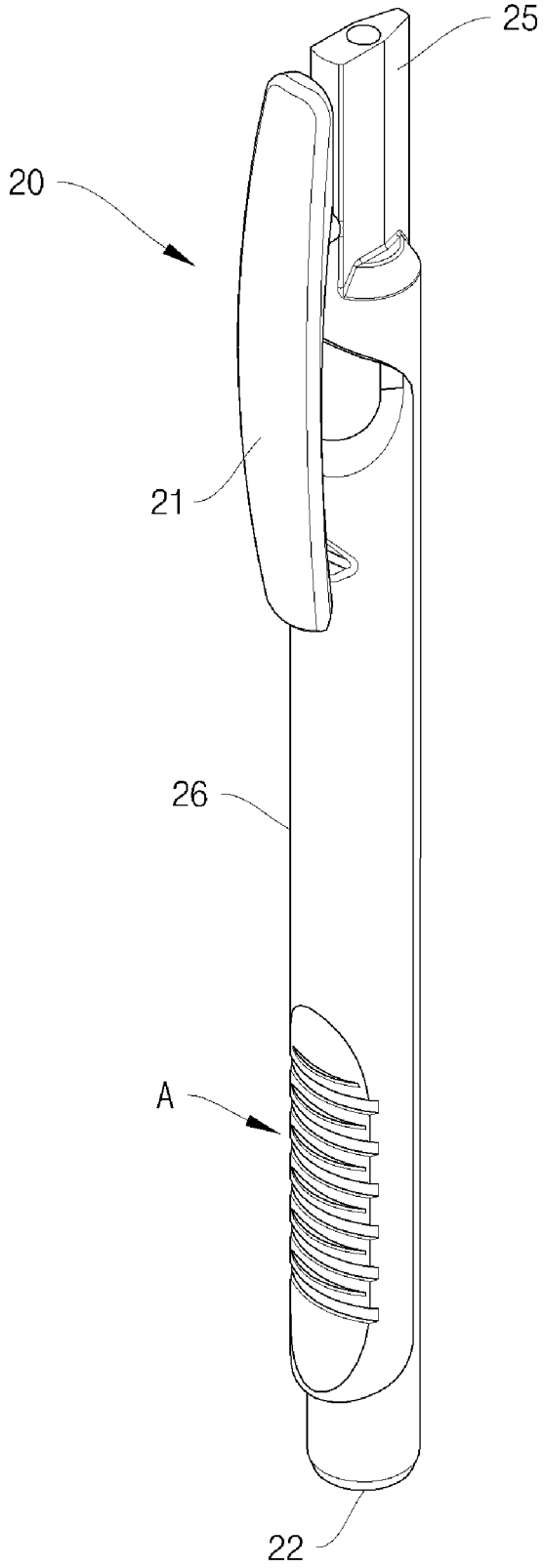
FIGS. 6A, 6B and 6C are a perspective view, a side view, and a sectional view, respectively, illustrating the pen core slider of a slide pen according to another embodiment of the present invention.
Figure 6B:
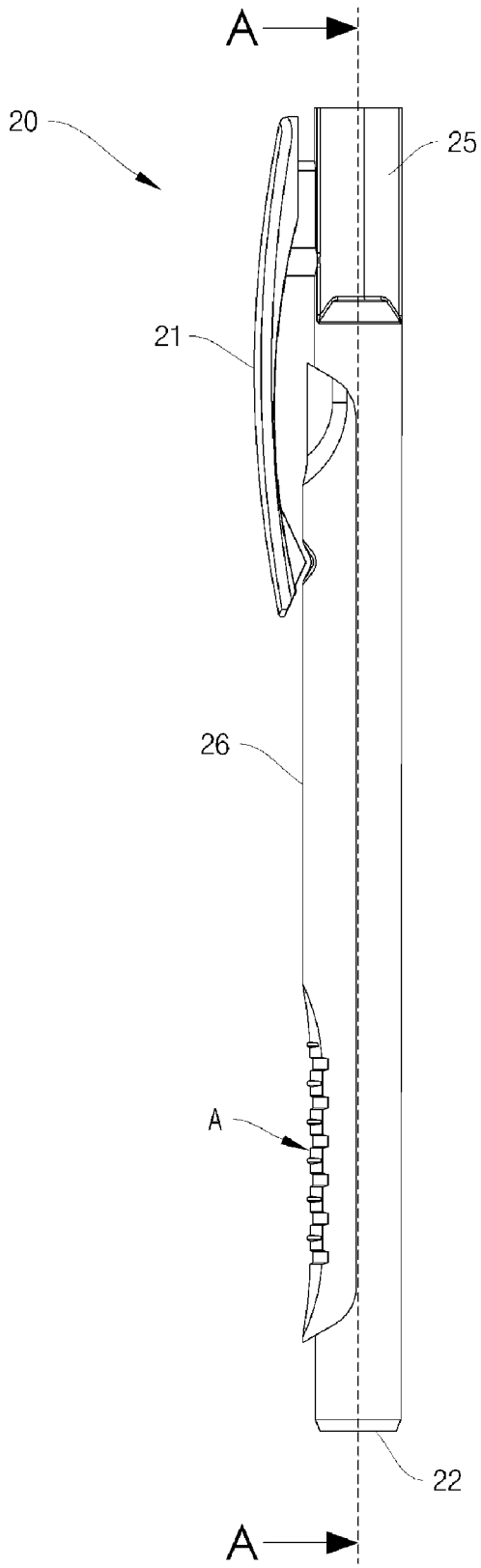
Figure 6C:
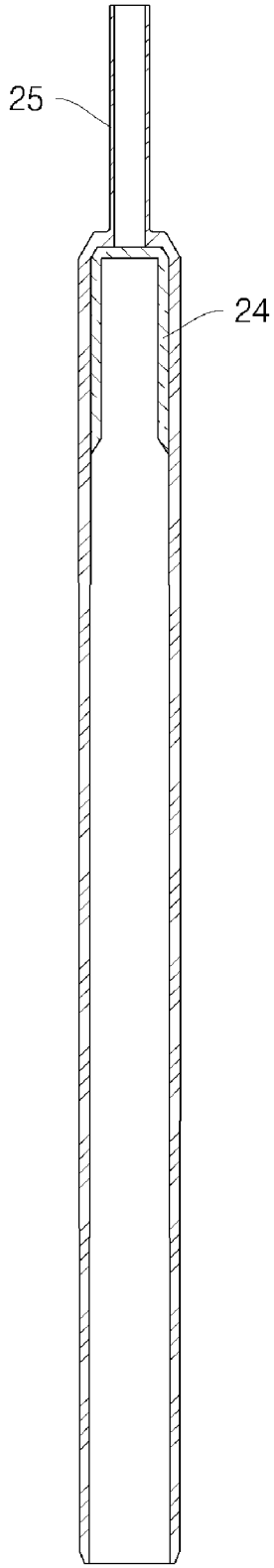

FIG. 6 illustrates a pen core slider 20 of a slide pen according to another embodiment of the present invention, wherein FIG. 6A is a perspective view of the pen core slider 20, FIG. 6B is a side view of the pen core slider 20, and FIG. 6C is a sectional view taken along line A-A in FIG. 6B.

The pen core slider 20 illustrated in FIG. 6 has the shape of a cylinder, unlike the above-described embodiment having the open intermediate portion (FIGS. 1 and 2), and includes a pen core coupler 24 formed with a circular step on the inner circumference of the upper portion of the pen core slider. Further, the pen core slider 20 illustrated in FIG. 6 is not provided with a pen core support 22, unlike the above-described embodiment having the open intermediate portion.

A pen core 1 is coupled to the pen core coupler 24 provided at the upper portion of the pen core slider 20, and is then held in a body casing 10.

The previous description applies equally to the other components of the pen core slider 20 of FIG. 6.

Meanwhile, as the pen core coupler 24 of the pen core slider 20, any construction will do as long as it is sufficient to withstand the force applied to the pen core 1 coupled to the pen core coupler 24 during a writing operation.

As described above, the slide pen of the present invention is generally comprised of a pen core, a pen core slider, and a body casing, so that it can provide a simple construction as well as easy assembly and operation.

As such, the slide pen provides an easy production process, and thus can save production cost.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A slide pen comprising:

a pen core having a nib;

a tubular pen core slider within which the pen core is housed along a majority of a longitudinal edge of the pen core, the slider having an open lower end, a pen core coupler at an upper inner portion of the slider, and guide ridges formed at an upper outer portion thereof, so as to allow the nib of the pen core to protrude through the lower end thereof and to allow the pen core to be held and coupled therein;

a body casing having a tubular upper portion formed with a guide slot to allow the guide ridges of the pen core slider to vertically move and be fixed, a tubular intermediate portion being partially open such that the pen core slider is held inside to allow an outer circumference of the pen core slider to be exposed outside, and a conical lower portion having an open lower end so as to allow the nib of the pen core to move in and out; and a sheath that encloses the outer circumference of the pen core slider and extends along a longitudinal length of the slider, the sheath is exposed to the open intermediate portion of the body casing when the pen core slider is held in the body casing and is formed beneath the guide ridges of the slider and thereby beneath the guide slot of the body casing when held in the body casing, wherein, when the guide ridges of the pen core slider vertically move in the guide slot of the upper portion of the body casing, the pen core slider slides in the body casing, and the nib of the pen core coupled to the pen core coupler of the pen core slider moves in and out through the lower end of the body casing.

2. The slide pen according to claim 1, wherein the guide slot of the upper portion of the body casing communicates with one end of the intermediate portion of the body casing to allow the guide ridges of the pen core slider to pass therethrough, and thereby allow the pen core slider coupled with the pen core to be assembled to the body casing.

3. The slide pen according to claim 1, wherein:

the guide ridges include a circular guide ridge having a circular shape in a vertical section and a quadrangular guide ridge having a quadrangular shape in a horizontal section and extending upwardly from the circular guide ridge; and the guide slot corresponding to the guide ridges includes a first passage slot that communicates with the open intermediate portion of the body casing so as to allow the guide ridges of the pen core slider to pass therethrough first when the pen core slider is held in the body casing, a pair of circular slots that communicates with the first passage slot and is formed up and down so as to be able to clamp the circular guide ridge of the guide ridges, a second passage slot that is formed between the paired circular slots and causes elastic deformation when the circular guide ridge passes therethrough, and a linear slot that communicates with the upper one of the paired circular slots and allows the quadrangular guide ridge of the guide ridges to pass therethrough.

4. The slide pen according to claim 1, wherein the sheath has a length equal to or shorter than that of the open intermediate portion of the body casing, wherein a movement distance of the sheath is equal to a distance that the guide ridges of the pen core slider move in the guide slot of the body casing.

5. The slide pen according to claim 1, wherein the pen core slider has a shape of a tube that is partially open so as not to be exposed when coupled to the body casing, the pen core coupler of the pen core slider includes a pair of opposite flat plates formed at an inner portion of the pen core slider, and the pen core is coupled between the pair of flat plates.

6. The slide pen according to claim 1, wherein the pen core slider further includes a clip, and the clip and the guide ridges are integrally formed.

7. The slide pen according to claim 4, wherein, when the nib of the pen core is moved out, embossed portions serving as grip portions of the sheath and the body casing are symmetrical with respect to each other.

* * * * *